US010502005B2

(12) United States Patent
Gil et al.

(10) Patent No.: US 10,502,005 B2
(45) Date of Patent: Dec. 10, 2019

(54) RETRIEVABLE TUBING CONNECTOR SYSTEM

(71) Applicant: Schlumberger Technology Corporation, Sugar Land, TX (US)

(72) Inventors: Joel Gil, Kuala Lumpur (MY); Tomaso Ceccarelli, Kuala Lumpur (MY); Wesley Ryan Atkinson, Kuala Lumpur (MY)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 613 days.

(21) Appl. No.: 14/597,972

(22) Filed: Jan. 15, 2015

(65) Prior Publication Data

US 2015/0197995 A1 Jul. 16, 2015

(30) Foreign Application Priority Data

Jan. 15, 2014 (MY) ..... PI 2014700106

(51) Int. Cl.
*E21B 17/06* (2006.01)
*E21B 17/042* (2006.01)
*E21B 17/04* (2006.01)

(52) U.S. Cl.
CPC ..... *E21B 17/042* (2013.01); *E21B 17/04* (2013.01)

(58) Field of Classification Search
CPC ..... E21B 17/042; E21B 17/04; F16L 1/09; F16L 1/10; F16L 39/005; F16L 15/08
USPC ..... 285/2, 90, 304, 913
See application file for complete search history.

(56) References Cited

U.S. PATENT DOCUMENTS 2,427,330 A * 9/1947 Spencer ..... E21B 43/10 166/208
2,644,524 A * 7/1953 Baker ..... E21B 17/06 166/114
4,949,793 A * 8/1990 Rubbo ..... E21B 23/00 166/134
6,095,243 A * 8/2000 Van Bilderbeek .... E21B 33/043 166/208
2013/0146305 A1* 6/2013 Dupal ..... E21B 19/16 166/380
2014/0151130 A1* 6/2014 Partouche ..... E21B 17/028 175/320
2014/0262343 A1* 9/2014 Larsen ..... E21B 33/1293 166/382
2016/0369920 A1* 12/2016 Pallini, Jr. ..... F16L 15/06

* cited by examiner

*Primary Examiner* — Taras P Bemko
*Assistant Examiner* — Yanick A Akaragwe

(57) ABSTRACT

A technique facilitates connection of tubing strings in which one tubing string is received in another tubing string. A connector has an inner connector which may be coupled with an inner tubing string and an outer connector which may be coupled with an outer tubing string. The inner connector is sealingly received in the outer connector and releasably held within the outer connector by a releasable member. The construction of the connector enables selective release of the inner connector from the outer connector by applying a suitable force.

17 Claims, 2 Drawing Sheets

RETRIEVABLE TUBING CONNECTOR SYSTEM

CROSS-REFERENCE TO RELATED APPLICATION

The present document is based on and claims priority to Malaysian Application No.: PI 2014700106, filed Jan. 15, 2014, incorporated herein by reference in its entirety.

BACKGROUND

Connectors are used to install concentric tubing strings in well completions, e.g. within sand control assemblies. Over the life of the well, interventions are sometimes performed to change out the inner string or to repair or isolate sections of the outer string. This type of intervention involves extensive work-over operations which are expensive and time-consuming. For example, a work-over operation may involve removal of the entire sand control completion or performance of a side-track followed by installation of a new sand face completion.

SUMMARY

In general, a system and methodology are provided for connecting tubing strings. A connector has an inner connector which may be coupled with an inner tubing string and an outer connector which may be coupled with an outer tubing string. The inner connector is sealingly received in the outer connector and releasably held within the outer connector by a releasable member. The construction of the connector enables selective release of the inner connector from the outer connector by applying a suitable force.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
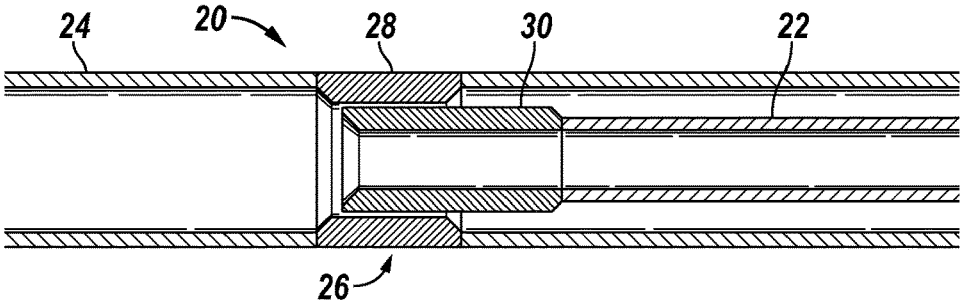
FIG. 1 is a schematic illustration of an example of a connection system releasably coupling an inner string within an outer string, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate connection of tubing strings. In many applications, the tubing strings are concentric tubing strings in which an inner tubing string is received in an outer tubing string. The connection is facilitated by a unique connector having an inner connector which may be coupled with the inner tubing string and an outer connector which may be coupled with the outer tubing string. In certain embodiments, the inner connector is received in the outer connector and sealed with respect to the outer connector via a suitable seal. The inner connector also may be releasably held within the outer connector by a releasable member, such as a shear member. The construction of the connector enables selective release of the inner connector from the outer connector by applying a suitable force. Once the inner connector is released, the inner tubing string may be removed from the outer tubing string or otherwise linearly positioned with respect to the outer tubing string.

In an embodiment, the tubing connection system may be employed in well applications to couple an inner well tubing string with an outer well tubing string. The connection system reduces or eases the work-over intervention of a wellbore by providing a three-way connector which enables straightforward retrieval of the inner tubing string without retrieving the outer tubing string. Consequently, intervention risks are reduced and operational time and cost savings are achieved.

By way of example, a retrievable three-way connector may be used to run isolation tubing inside of screens or slotted liners. The three-way connector may be used to run many types of internal well tubing strings inside liners or other tubulars to establish internal isolation between sections of the same outer tubing string. The inner tubing string can later be decoupled by, for example, engaging a work-string with the inner tubing string and retrieving the inner tubing string while leaving the outer tubing string in the well.

The connector may be employed to attach the inner string to the outer string while providing structural and pressure integrity between the inner and outer strings. In some applications, the connector enables the inner and outer tubing strings to be connected and run simultaneously. The connector also may be employed to provide testable pressure integrity between the inner tubing string and the outer tubing string. In some embodiments, the connector is constructed to enable coupling of the inner tubing string and the outer tubing string without relative rotation of the tubing strings while also enabling torque transfer between the tubing strings once the inner tubing string and outer tubing string are fully coupled together.

In various embodiments, the connector is formed with an outer connector into which an inner connector is sealingly received. The inner connector may be releasably held within the outer connector by a releasable member, e.g. a shear member. Additionally, the outer connector is provided with a sufficiently large inside diameter to enable retrieval of the inner connector and the inner tubing string through the outer connector while the outer connector and outer tubing string remain in place. The inside diameter of the outer connector also may be sized to enable removal of a variety of equipment coupled into the inner tubing string. For example, packers, seals, locators, subsurface safety devices, flow control valves, gauge mandrels, and/or other types of devices may be passed through the outer connector during retrieval of the inner tubing string. The connector also may be constructed as a quick-coupling connector which is useful with, for example, various completions using a stab-in connection. The stab-in connection enables coupling of the tubing strings without relative rotation of the assembly immediately above the connector.

Referring generally to FIG. 1, an example of a tubing system 20 is illustrated as having an inner tubing string 22 deployed within an outer tubing string 24. The inner tubing string 22 is coupled with the outer tubing string 24 by a connector 26 which allows selective release of the inner tubing string 22 from the outer tubing string 24. In this example, the connector 26 comprises an outer connector 28 and an inner connector 30 which is received in the outer connector 28. In some applications, the inner connector 30 is sealingly received in the outer connector 28, as discussed in greater detail below.

In the example illustrated, the inner tubing string 22 and the outer tubing string 24 may be constructed in many configurations and may include a variety of components and features which may be tubular in form or non-tubular. Additionally, the outer connector 28 and/or the inner connector 30 may be coupled with an individual tubing section or a pair of tubing sections. In the embodiment illustrated, for example, the outer tubing string 24 is formed from a pair of tubing sections joined by outer connector 28. However, outer connector 28 may be mounted within a continuous, unitary tubing.

Figure 2:
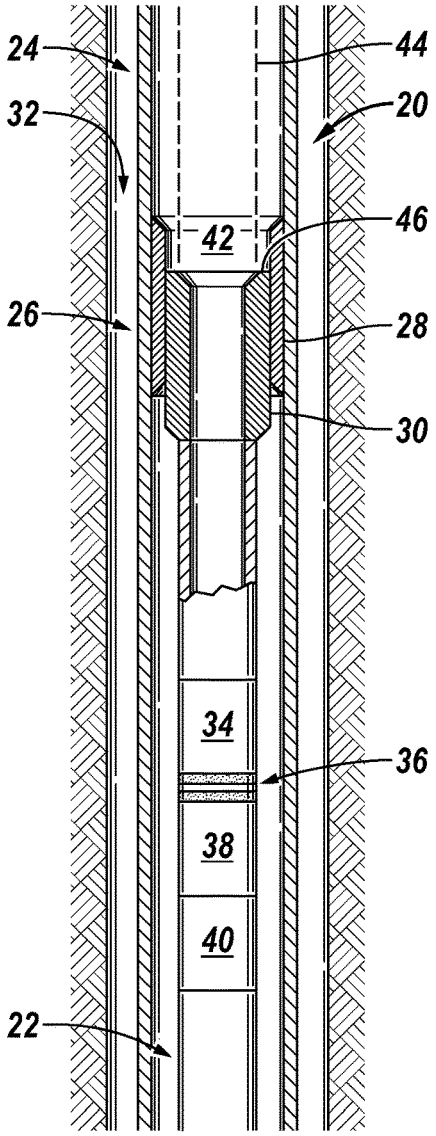
FIG. 2 is a schematic illustration of an example of a connection system deployed in a wellbore to releasably connect an inner well string within outer well string, according to an embodiment of the disclosure.

In FIG. 2, an embodiment of tubing system 20 is illustrated as deployed in a wellbore 32. In this example, the inner string 22 is an inner, well tubing string and the outer string 24 is an outer, well tubing string deployed downhole into wellbore 22. The inner tubing string 22 may be coupled with outer tubing string 24 via connector 26 prior to deployment downhole into wellbore 32, and then the concentric tubing strings 22, 24 may be deployed downhole simultaneously. In some applications, however, the connector 26 may be constructed so that the outer tubing string 24 is deployed initially and then the inner tubing string 22 is lowered down through outer tubing string 24 until inner connector 30 engages, e.g. stabs-in, and couples with outer connector 28.

The components and configurations of inner tubing string 22 and outer tubing string 24 may vary substantially depending on the application. By way of example, the inner tubing string 22 may comprise many types of components to facilitate desired well operations. Examples of components that may be included in inner tubing string 22 include packers 34, seals 36, locators 38, sliding sleeves 40, and/or other components. In the embodiment illustrated, the inside diameter of outer connector 28 is sufficiently large to create an opening 42 through which inner tubing string 22, including components 34, 36, 38, 40, can pass. By using this relatively large inside diameter, the inner tubing string 22 and its components may be readily retrieved while the outer tubing string 24 remains in place, e.g. remains downhole.

The inner tubing string 22 may be retrieved or otherwise moved with respect to outer tubing string 24 by releasing inner connector 30 from outer connector 28. In at least some embodiments, the inner connector 30 may be released from outer connector 28 by applying a sufficient linear force, e.g. a sufficient pull force, to the inner connector 30 and inner tubing string 22. In certain well applications, the linear force may be applied by a tubing 44 coupled to inner connector 30 at, for example, an uphole end 46 of inner connector 30. By way of example, the tubing 44 may be a completion-related tubing coupled with inner connector 30 or tubing 44 may be a work string lowered downhole to engage inner connector 30 for retrieval of inner tubing string 22.

Figure 3:
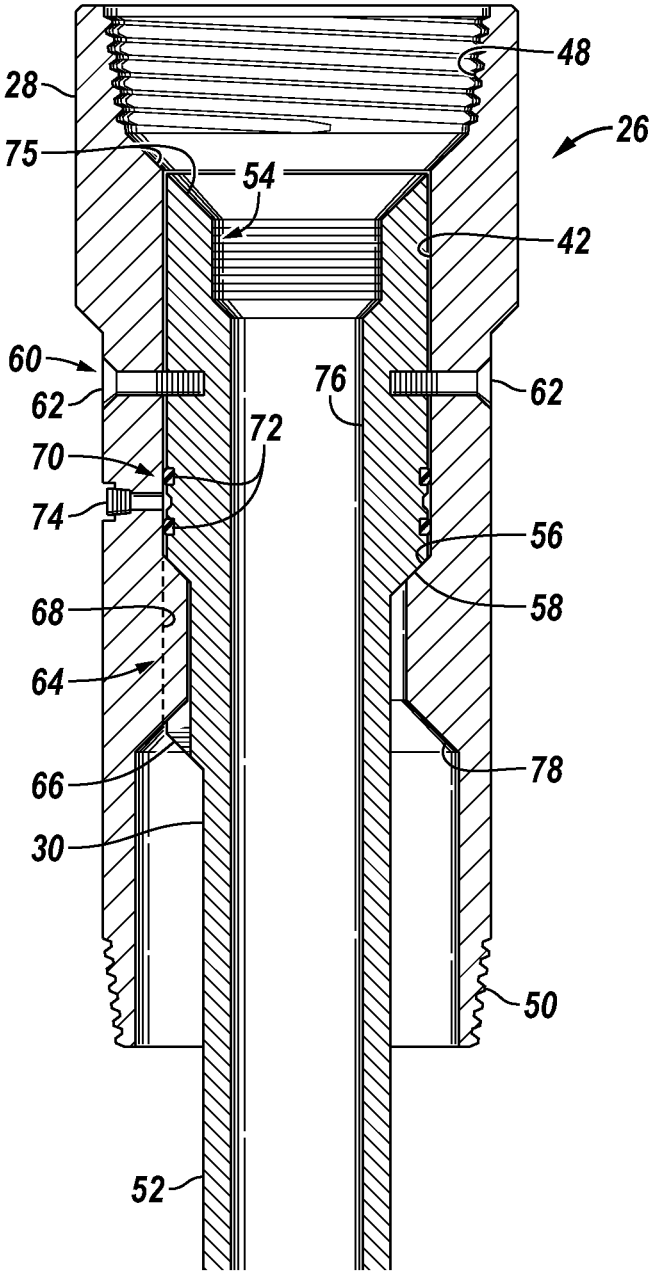
FIG. 3 is a cross-sectional view of an example of a connector which may be used to couple an inner tubing string within an outer tubing string, according to an embodiment of the disclosure.

Referring generally to FIG. 3, an embodiment of connector 26 is illustrated. In this embodiment, connector 26 is a retrievable, three-way connector which may be coupled with outer tubing sections uphole and downhole of the outer connector 28 and coupled with an inner tubing section downhole of the inner connector 30. In this example, the outer connector 28 has an uphole connection end 48 and a downhole connection end 50 which connect with sections of outer tubing string 24. The inner connector 30 also has a downhole connection end 52 which connects with inner tubing string 22. The connection ends 48, 50 and 52 enable making up of two concentric tubing strings. The inner connector 30 also may comprise a connection or engagement feature 54 located at, for example, uphole end 46 to facilitate engagement of tubing 44. The connection or engagement feature 54 comprises a suitable latch or threads to receive and engage a corresponding feature on tubing 44. In various well applications, the tubing system 20 may be constructed so the outer connector 28 remains attached to the outer tubing string 24 and is left in the wellbore 32 when the inner tubing string 22 is retrieved.

As illustrated in FIG. 3, the inner connector 30 is received in the outer connector 28. For example, the inner connector 30 may be moved linearly down into opening 42 of outer connector 28 until a shoulder 56 of inner connector 30 engages a corresponding shoulder 58 of outer connector 28. Once shoulder 56 engages corresponding shoulder 58, the linear movement of inner connector 30 with respect to outer connector 28 is stopped and the inner connector 30 is landed in outer connector 28. In the landed position, the inner connector 30 is releasably held in place within the outer connector 28 with a releasable member 60. The releasable member 60 may comprise a variety of latches or shear members which control release of inner connector 30 from outer connector 28 upon application of a sufficient linear force on inner connector 30, e.g. a straight pull force applied by work string 44. By way of example, the releasable member 60 may comprise a plurality of shear members 62, such as shearable set screws. In some embodiments, releasable member 60 may comprise a latch constructed to enable stabbing-in of inner connector 30 into outer connector 28 at, for example, a downhole location.

In the example illustrated, the connector 26 further comprises an anti-rotation feature 64 which blocks rotation of inner connector 30 with respect to outer connector 28 and enables transmission of torque between the inner tubing string 22 and the outer tubing string 24. The anti-rotation feature 64 may comprise a variety of notches, teeth, splines, or other interfering members. In the embodiment illustrated, the anti-rotation feature 62 comprises a spline 66 which slides into a corresponding spline slot 68 to block relative rotation of inner connector 30 with respect outer connector 28.

The connector 26 also may be designed so that inner connector 30 is sealingly received in the outer connector 28 via a seal 70. Seal 70 may comprise a variety of elastomeric seals designed to form a seal between the inner connector 30 and outer connector 28 along the inside diameter of outer connector 28. The elastomeric seal or seals may comprise various types and structures of sealing material, including chevron seals, T-seals, O-ring seals, combinations of seals, and/or other types of suitable seals. In the embodiment illustrated, seal 70 comprises a plurality of O-ring seals 72. The use of seals such as O-ring seals 72 enables easy assembly of connector 26 even when the connector is assembled at, for example, a well site. The seal 70 may be pressure tested via a pressure test port 74 disposed through outer connector 28. In the example illustrated, pressure test port 74 extends through outer connector 28 to a position between a pair of the O-ring seals 72.

The connector 26 may be assembled at various stages of an operation. By way of example, the connector 26 may be pre-assembled in a workshop prior to delivery to a work site; or the connector 26 may be assembled at the work site, e.g. at a well site. In a well application, the inner connector 30 may be attached to the inner tubing string and the inner tubing string 22 may be run inside the outer tubing string 24. Once the inner connector 30 is landed inside the outer connector 28, the releasable member 60, e.g. shearable set screws 62, are installed to couple the inner connector 30 and outer connector 28. The seals 70/72 may then be pressure tested via pressure test port 74. If the pressure test is successful, the inner tubing string 22 and outer tubing string 24 may be simultaneously deployed downhole while coupled together with connector 26. In some applications, however, releasable member 60 may be constructed as a latch allowing later stab-in of the inner connector 30 and inner tubing string 22.

In the embodiment illustrated, the uphole ends of outer connector 28 and inner connector 30 comprise chamfered regions 75. The chamfered regions 75 facilitate easy passage of tools, e.g. slick-line tools, into an internal passage 76 of inner connector 30 and ultimately into the interior of inner tubing string 22. The downhole side of outer connector 28 also may comprise a chamfered region 78 along its inner profile. The chamfered region 78 facilitates withdrawal of the inner tubing string 22 including jewelry such as packers 34, seals 36, locators 38, sliding sleeves 40, subsurface safety devices, and/or other components of inner tubing string 22. The inside diameter of outer connector 28 and of any uphole completion connected to outer connector 28 also are sized to facilitate withdrawal of inner tubing string 22 and its various components.

Many types of materials, components, and component configurations may be used in constructing the connector and the tubing strings. For example, the connector may be formed from a variety of steels and/or other components, and those components may have various sizes and configurations. The connector also may utilize various types of releasable members, shear members, seals, anti-rotation features, landing features, engagement features, and/or other features or components according to the parameters of a given application. Similarly, the inner tubing string and the outer tubing string may be constructed in a variety of sizes and with many types of components. For example, the tubing strings may comprise a variety of completion components assembled for deployment in a desired well application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for coupling tubing, comprising:

an inner tubing string;

an outer tubing string; and a three-way connector, comprising:

an outer connector comprising an uphole connection end and a downhole connection end, wherein the outer connector is coupled with the outer tubing string via the uphole connection end of the outer connector and the downhole connection end of the outer connector; and an inner connector comprising a downhole connection end, wherein the inner connector is coupled with the inner tubing string via the downhole connection end of the inner connector, the inner connector being sealingly received in the outer connector and releasably held within the outer connector by a shear member in a manner enabling release of the inner connector upon application of a sufficient pull force on the inner connector, which enables retrieval of the inner tubing string from the outer tubing string without retrieving the outer tubing string, wherein the three-way connector further comprises an anti-rotation feature, which blocks rotation of the inner connector with respect to the outer connector and enables transmission of torque between the inner tubing string and the outer tubing string.

2. The system as recited in claim 1, wherein the inner connector has a shoulder which lands on a corresponding shoulder of the outer connector when the inner connector is received in the outer connector.

3. The system as recited in claim 1, wherein the shear member comprises a plurality of shearable set screws.

4. The system as recited in claim 1, wherein the inner tubing string comprises a packer, a locator, and a sliding sleeve, the outer connector having an inside diameter large enough to allow passage of the packer, the locator, and the sliding sleeve.

5. The system as recited in claim 1, wherein the three-way connector further comprises a plurality of 0-ring seals which allow the inner connector to be sealingly received in the outer connector.

6. The system as recited in claim 1, wherein the inner connector comprises an engagement feature oriented for connection to a retrieval work string.

7. The system as recited in claim 1, wherein the inner connector is chamfered at an uphole end.

8. The system as recited in claim 1, wherein the outer connector is chamfered at a downhole end.

9. The system as recited in claim 1, wherein the anti-rotation feature comprises a spline.

10. A method for coupling tubing, comprising:

coupling an inner tubing string with a downhole connection end of an inner connector;

coupling an outer tubing string with an uphole connection end and a downhole connection end of an outer connector;

positioning the inner tubing string within the outer tubing string such that the inner connector is landed in the outer connector;

providing the outer connector with an inside diameter sufficiently large to enable withdrawal of the inner tubing string through the outer connector;

sealing the inner connector to the outer connector;

securing the inner connector to the outer connector with a releasable member, wherein securing comprises securing the inner connector to the outer connector with the releasable member in the form of a shear member;

using an anti-rotation feature to block rotation of the inner connector with respect to the outer connector and enable transmission of torque between the inner tubing string and the outer tubing string;

pulling on the inner connector to release the releasable member; and subsequently withdrawing the inner tubing string through the outer connector without withdrawing the outer tubing string.

11. The method as recited in claim 10, wherein sealing comprises placing an elastomeric seal between the inner connector and the outer connector.

12. The method as recited in claim 10, wherein sealing comprises placing a plurality of O-ring seals between the inner connector and the outer connector.

13. The method as recited in claim 10, further comprising providing the outer connector with a pressure test port.

14. The method as recited in claim 10, further comprising deploying the inner tubing string and the outer tubing string in a wellbore.

15. A device for connecting concentric tubing strings, comprising:

a three-way connector having:

an inner connector received in an outer connector;

a seal disposed between the inner connector and the outer connector;

a shoulder to linearly position the inner connector with respect to the outer connector;

a releasable member to releasably secure the inner connector to the outer connector, the releasable member being configured to release the inner connector from the outer connector upon application of a sufficient linear pull force on the inner connector; and an anti-rotation feature blocking rotation of the inner connector with respect to the outer connector, and enabling transmission of torque between the inner connector and the outer connector.

16. The device as recited in claim 15, wherein the inner connector comprises a chamfered end on a first end of the three-way connector and the outer connector comprises another chamfered end on a second end of the three-way connector.

17. The device as recited in claim 15, wherein the releasable member comprises a shear member.

* * * * *